US005694848A

United States Patent [19]

Palmatier

[11] Patent Number: 5,694,848

[45] Date of Patent: Dec. 9, 1997

[54] PRINTING UNIT FOR WATER BASED INKS

[75] Inventor: Roland Thomas Palmatier, Durham, N.H.

[73] Assignees: Heidelberger Druckmaschinen AG, Heidelberg, Germany; Heidelberg Harris, Inc., Dover, N.H.

[21] Appl. No.: 615,351

[22] Filed: Mar. 13, 1996

[51] Int. Cl.[6] ..... B41F 5/04

[52] U.S. Cl. ..... 101/219; 101/349; 101/487; 101/424.1

[58] Field of Search ..... 101/216, 219, 101/220, 147, 148, 375, 376, 424.1, 416.1, 483, 487, 488, 349, 351

[56] References Cited

U.S. PATENT DOCUMENTS

| | | | |
|---|---|---|---|
| 2,260,364 | 10/1941 | Case | 101/487 |
| 2,972,298 | 2/1961 | De Marchi et al. | 101/211 |
| 2,972,302 | 2/1961 | Bernardi | 101/491 |
| 3,031,961 | 5/1962 | Czeropski et al. | 101/488 |
| 3,141,408 | 7/1964 | Bernardi et al. | 101/488 |
| 3,356,030 | 12/1967 | Greubel . | |
| 3,741,115 | 6/1973 | Keller | 101/148 |
| 3,877,372 | 4/1975 | Leeds . | |
| 4,173,554 | 11/1979 | Sulzberg . | |
| 4,278,467 | 7/1981 | Fadner . | |
| 4,854,969 | 8/1989 | Bassemir et al. . | |
| 4,920,881 | 5/1990 | Tafel | 101/488 |
| 4,954,556 | 9/1990 | Bull et al. . | |
| 5,026,755 | 6/1991 | Kveglis et al. . | |
| 5,098,478 | 3/1992 | Krishnan et al. . | |
| 5,174,206 | 12/1992 | Molinatto | 101/424.1 |
| 5,309,838 | 5/1994 | Kurz . | |
| 5,370,906 | 12/1994 | Dankert . | |
| 5,375,518 | 12/1994 | Kurz . | |
| 5,417,749 | 5/1995 | Krishnan et al. . | |
| 5,429,051 | 7/1995 | Laubscher | 101/488 |
| 5,452,657 | 9/1995 | Kurz . | |
| 5,465,661 | 11/1995 | White | 101/487 |
| 5,471,927 | 12/1995 | Frank et al. | 101/487 |

FOREIGN PATENT DOCUMENTS

| | | | |
|---|---|---|---|
| 0062053 | 4/1983 | Japan | 101/424.1 |
| 0191152 | 8/1987 | Japan | 101/487 |
| 362227749 | 10/1987 | Japan | 101/487 |
| 321453 | 6/1989 | Japan | 101/487 |
| 0101938 | 4/1991 | Japan | 101/487 |

OTHER PUBLICATIONS

Leach, R. H. et al., "Inks and Varnishes for Specific Purposes," *The Printing Ink Manual*, Fifth Edition, 1993, pp. 571–576.

*Primary Examiner*—Eugene R. Eickholt
*Attorney, Agent, or Firm*—Kenyon & Kenyon

[57] ABSTRACT

A printing unit for rotary printing press includes an inking unit and a print cylinder carrying a print form suitable for the reception of water based inks. The printing unit also includes a blanket cylinder carrying a printing blanket and a cooling unit for maintaining an ink carrying surface of one or more of the print form, the printing blanket, and the inking unit at a predetermined temperature which is suitable for printing with water-based inks.

22 Claims, 8 Drawing Sheets

PRINTING UNIT FOR WATER BASED INKS

FIELD OF THE INVENTION

The present invention relates to a printing unit for using water based inks in high speed rotary printing presses.

BACKGROUND OF THE INVENTION

U.S. Pat. Nos. 5,309,838, and 5,375,518 each purport to disclose a system for keeping the printing plates of a printing press at a moderate temperature. A cooling air blower girder extends longitudinally over the printing plate surface and blows cold air onto the printing plate's surfaces in order to keep its temperature of a desired value. The blast air girder contains at least one heat exchanger and at least one blower as well as at least one air return duct, which together forms a cooling air cycle, through which the air blown onto the printing plate surface is returned to the air inlet of the heat exchanger and optionally mixed with fresh air blown by the blower once again through the heat exchanger onto the printing plate surface. The blast air girder purportedly presents an energy saving compact structural unit for keeping the printing plate surface at a moderate temperature.

U.S. Pat. No. 5,452,657 purportedly relates to a temperature control system for printing press cylinders. It contains at least one compressed air line having at least one blast air opening for blowing cold air against a cylinder which is to be cooled. At least one recirculation circuit which is separate from the cold air of the compressed air line and by which air which has been blown by the blast air opening onto the cylinder is drawn off by means of a blower contained in the circulation circuit and is blown parallel to the cold air again onto the cylinder. In this way, the temperature of the cold air can be active, without prior change of temperature on the cylinder. The cold air deflected by the cylinder is returned to the cylinder for additional cooling.

U.S. Pat. No. 5,098,478 relates to water based ink compositions. The water based ink composition comprises water, a pigment, a non-ionic surfactant having a solubility in water of less than about 0.5 wt % and a solubilizing agent sufficient to solubilize substantially all of the none-ionic surfactant.

U.S. Pat. No. 5,026,755 purports to disclose a water based printing ink prepared from polyamid/acrylic graft copolymers. It is prepared by reacting the polyamid with the acrylic monomer or monomers in an alcohol solution in the presence of a free radical peroxidic initiator. The graft copolymer purports to be particularly useful as the resin component of a water based printing ink.

Finally, German laid open patent application DE 41 19 348 A1 purports to disclose a method for offset printing and a printing unit for waterless offset printing. A conventional offset plate is used with a water based printing ink, containing a pigment, water, 5–50% water soluble macromolecular binding agents, a hygroscopic organic fluid and preferably a multivalent alcohol.

SUMMARY OF THE INVENTION

In accordance with the present invention, a printing unit is provided for printing with water-based inks. Such water-based inks provide many advantages over conventional inks, but have proven difficult to use in an offset printing unit. Preferably, the present invention uses a water-based ink which is free of volatile organic components (VOCs). VOCs, such as hydrocarbons, are conventionally evaporated from inks in long driers. As a result, VOC-free water-based inks dry cleaner, with little or no air pollution. Moreover, since these water-based inks have no VOCs to evaporate, they require less temperature to dry. This, in turn, allows a reduction in the length of the driers. Finally, with the use of water-based inks with no VOCs, alternative drying mechanisms such as infra red or micro-wave drying are possible in offset presses. However, it has been found that water-based inks are difficult to use in offset printing because the ink is highly sensitive to temperature and humidity variations, and tends to dry prematurely.

In accordance with the present invention, a printing unit for printing with water based inks includes a blanket cylinder for supporting a printing blanket, a print cylinder for supporting a print form, and an inking unit for applying a water-based ink over the print form. The printing blanket, print form, and inking unit each have respective ink carrying surfaces for transferring the water-based ink. A cooling unit is mounted within the printing unit for maintaining the outer ink carrying surface of one or more of the print form, printing blanket, and inking unit at a predetermined level. Since heating and cooling above the dew point will not result in condensation, the predetermined temperature level is preferably set above the dew point of the atmosphere surrounding the ink carrying surfaces to prevent condensation of the water in the atmosphere onto the ink carrying surfaces. Moreover, in accordance with a preferred embodiment of the invention, the predetermined temperature level is set just slightly above the dew point so that evaporation of water from the ink is minimized while still preventing condensation.

In accordance with another embodiment of the present invention, the cooling unit includes a blanket cylinder cooling unit coupled to the blanket cylinder for circulating a first cooling agent through the blanket cylinder. In addition, a blanket temperature sensor is mounted within the printing unit for monitoring the temperature at the outer ink carrying surface of the printing blanket, and a control unit is provided which has an input connected to the blanket temperature sensor, and an output connected to the blanket cylinder cooling unit. The control unit monitors the temperature at the outer ink carrying surface of the printing blanket via the blanket temperature sensors, and controls the temperature at the outer ink carrying surface of the printing blanket by controlling the temperature of the first cooling agent.

In accordance with another embodiment of the present invention, the cooling unit may include a print cylinder cooling unit alone or in combination with the blanket cylinder cooling unit described above. The print cylinder cooling unit is coupled to the print cylinder for circulating a second cooling agent through the print cylinder. A print form temperature sensor is mounted within the printing unit for monitoring the temperature at the outer ink carrying surface of the print form, and the control unit has an input connected to the print form temperature sensor, and an output connected to the print cylinder cooling unit. The control unit monitors the temperature at the outer ink carrying surface of the print form via the print form temperature sensor, and controls the temperature at the outer ink carrying surface of the print form by controlling the temperature of the second cooling agent.

In addition, the cooling unit may also include inker cooling unit alone or in combination with the print cylinder and blanket cylinder cooling units described above. The inker cooling unit is coupled to one or more of a plurality of rollers within the inking unit (e.g., vibrator rollers) and circulates a third cooling agent through these rollers. A inking unit temperature sensor is mounted within the printing unit for monitoring the temperature at the outer ink carrying surface of the rollers, and the control unit has an input connected to the inking unit temperature sensor, and an output connected to the inker cooling unit. The control unit monitors the temperature at the outer ink carrying surface of the rollers via the inking unit temperature sensor, and controls the temperature at the outer ink carrying surface of the rollers by controlling the temperature of the third cooling agent.

In accordance with a further embodiment of the present invention, an air blower is mounted within the printing unit for circulating and conditioning the atmosphere surrounding the blanket cylinder, print cylinder, and/or inking unit. While the air blower may be used independently from the cooling unit, in accordance with a preferred embodiment of the present invention, the air blower is used in combination with the cooling unit described above.

BRIEF DESCRIPTION OF THE DRAWINGS

FIG. 3(*a*) shows an illustrative flow chart for the control unit of FIG. 3.

DETAILED DESCRIPTION OF THE INVENTION

Figure 1:
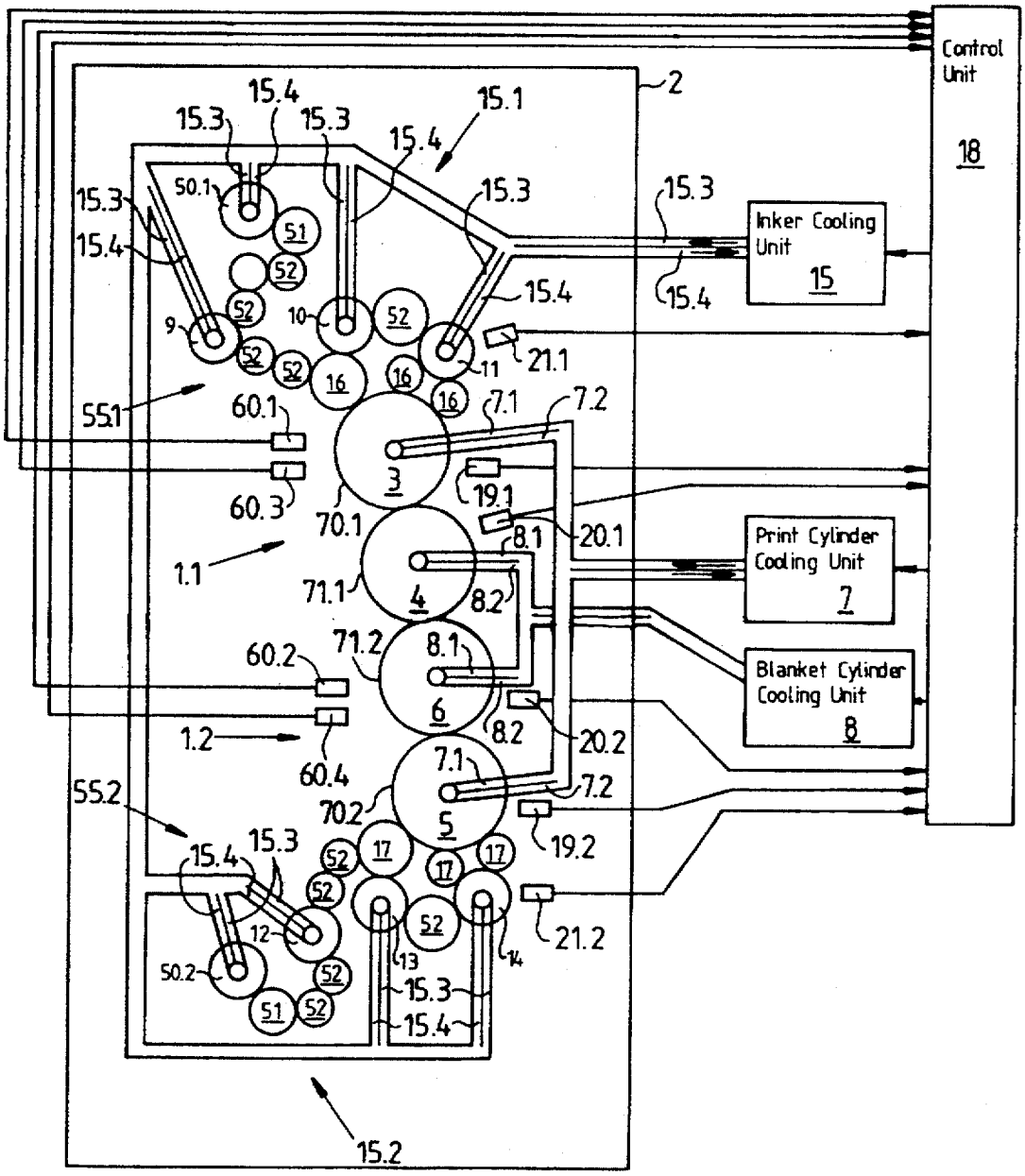
FIG. 1 shows a printing unit in accordance with an embodiment of the present invention.

FIG. 1 shows a printing unit 1 in accordance with the present invention. The printing unit 1 includes side walls 2 supporting upper and lower inking units 55.1, 55.2, blanket cylinders 4, 6 and print cylinders 3, 5. The upper inking unit 55.1 includes a fountain roller 50.1 and metering roller 51 which apply an ink film to distributor rollers 52, and to vibrator rollers 9, 10 and 11 for splitting the ink film and providing an even ink profile over the width of the printing unit. The vibrator rollers 10, 11 distribute the ink film to a group of upper form rollers 16. The upper form rollers 16, in turn, apply the ink film to a print form 70.1 mounted on the upper print cylinder 3. Similarly, the vibrator rollers 13, 14 distribute the ink film to a group of lower form rollers 17, and the lower form rollers 17 apply the ink film to a print form 70.2 mounted on the lower print cylinder 5.

The print form 70 may be constructed as a flat plate mounted by its respective ends to the print cylinder, as a sleeve-shaped print form mounted axially over the print cylinder, or in any other known manner. In any case, the print form 70 is suitable for receiving and transferring an image using water based inks. For example, it has been found that "waterless" type printing plates, such as those manufactured by Toray Industries, are also suitable for printing with water based inks. As an example, a Toray Industries printing plate having an aluminum oxide substrate with an image area coated with a photopolymer whose surface is hydrophilic in nature and a non-image area coated with a silicone polymer may be used.

An illustrative water-based ink for use with the present invention may include the components set forth below. The water phase of the ink is supplied by the water present in the acrylic resin latex, hydroxypropyl cellulose, hydroxyethyl ethylene urea, and the maleated rosin ester.

| Component | Amount, wt. % |
|---|---|
| Styrene/maleic anhydride resin | 12 |
| Phthalocyanine Blue pigment | 12 |
| Acrylic resin latex (50% wt. % solids) | 5 |
| Hydroxypropylcellulose (3% wt. % soiids) | 10 |
| Hydroxyethylethylene urea (70% wt % solids) | 8 |
| Monoethanol amine | 2 |
| Polyethylene Wax | 2 |
| Ethoxylated acetylenic diol surfactant | 2 |
| Maleated rosin ester (50 wt. % solids) | 47 |
| Total | 100 |

The printing unit 1 is designed to maintain acceptable printing conditions for printing with water based inks through the use of one or more cooling units. Referring to FIG. 1, a print cylinder cooling unit 7 is assigned to the upper and lower print cylinders 3, 5. The print cylinder cooling unit 7 includes a print cylinder inlet pipe 7.1 and a print cylinder outlet pipe 7.2 for each of the print cylinders 3, 5. A lower print cylinder sensor 19.2 is arranged near the lower print cylinder 5, and an upper print cylinder sensor 19.1 is arranged near the upper print cylinder 3. A pair of relative humidity sensors 60.1, 60.2 are mounted within the printing unit 1 to measure the relative humidity of the atmosphere in the upper print unit section 1.1 and lower printing unit section 1.2, and a pair of temperature sensors 60.3, 60.4 are mounted within the printing unit 1 to measure the temperature of the atmosphere in the upper print unit section 1.1 and lower printing unit section 1.2. A control unit 18 has respective inputs connected to the print cylinder sensors 19.1, 19.2, the relative humidity and temperature sensors 60.1, 60.2, 60.3, 60.4 and an output connected to the cooling unit 7. The control unit 18 periodically monitors the temperature of the print cylinders 3, 5 via the sensors 19.1, 19.2, and of the atmosphere with the relative humidity sensors 60.1, 60.2 and temperature sensors 60.3, 60.4, and then controls the print cylinder cooling unit 7 as a function of the monitored temperature values.

The print cylinder sensors 19.1, 19.2 can be constructed, for example, as infra-red sensors mounted adjacent to the print cylinders 3, 5 to monitor the surface temperature of the print cylinders. The cooling unit 7 continuously circulates a cooling agent (e.g. water or air) through the print cylinders 3, 5 via the print cylinder inlet and outlet pipes 7.1, 7.2. By controlling the temperature of the cooling agent via the controlling device 18, the temperature of the cylinders 3, 5 can be maintained at a predetermined level (e.g., at a setpoint or within a predetermined range). The predetermined level is preferably set slightly above the dew point of the atmosphere surrounding the ink carrying surfaces of the print cylinders in order to prevent condensation of water from the atmosphere onto the ink carrying surfaces, and to minimize evaporation of water from the water-based inks into the atmosphere.

The predetermined level can be set as follows based upon the sensor readings. Relative humidity (RH) is a function of the amount of water per volume of air which is actually present in the atmosphere (VA) and the amount of water per volume of air which is necessary to saturate the air (VS): $VA/VS \times 100 = RH$. VS, in turn, is a function of the temperature of the atmosphere: $VS = f(t)$. Since the temperature of the atmosphere is known from sensors 60.3, 60.4, and the relative humidity of the atmosphere is known from sensors 60.1, and 60.2, VA and VS for the temperature of the atmosphere surrounding the ink carrying surfaces are readily determined by the control unit 18. Therefore, in order to maintain the temperature of the ink carrying surfaces above the dew point, the control unit can assume VA to remain constant, and choose a predetermined temperature level for the cylinders 3, 5 which has a corresponding VS which is slightly greater than VA.

Figure 3:
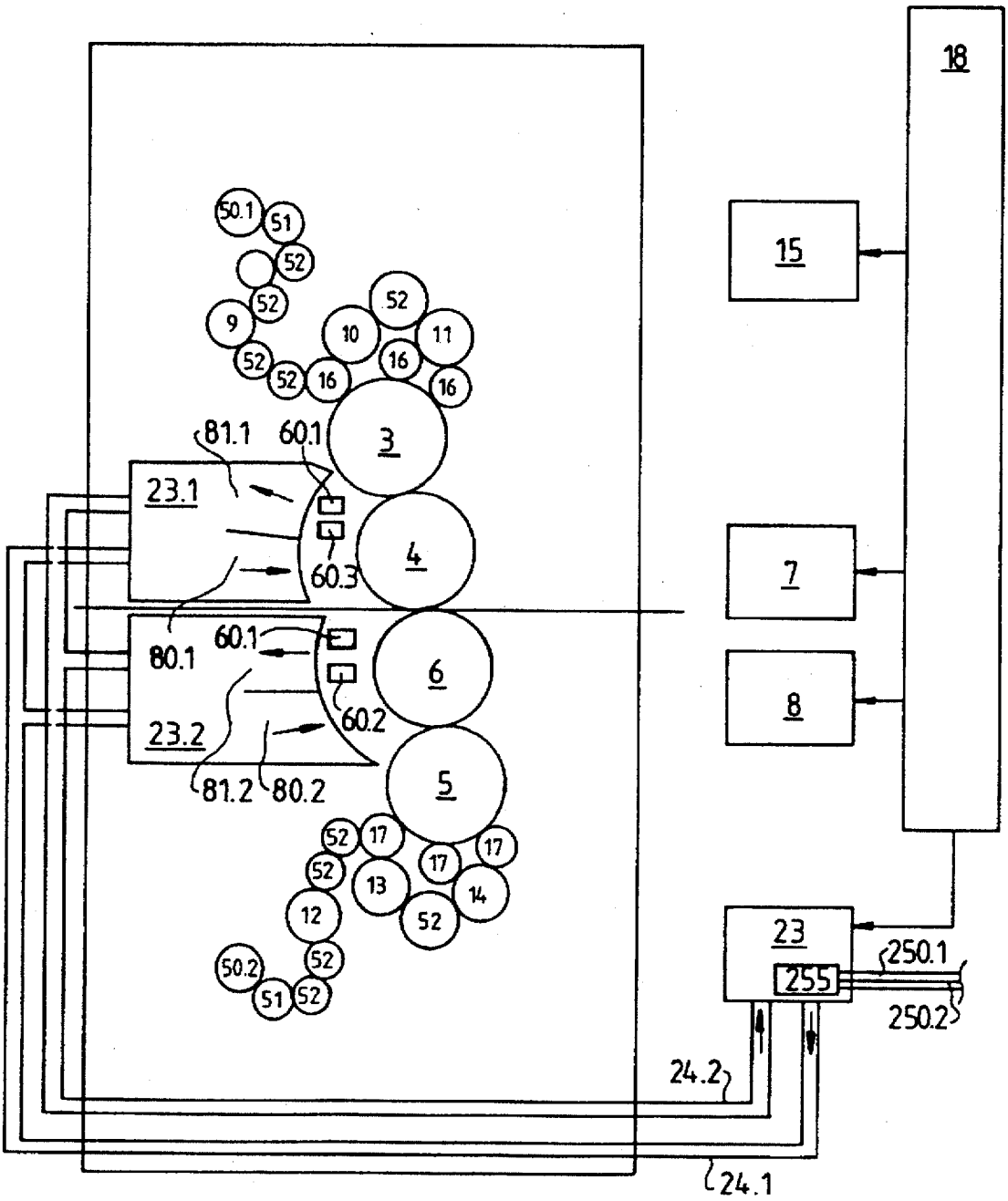
FIG. 3 shows a further embodiment of the printing unit of FIG. 1.

The upper and lower blanket cylinders 4, 6 have printing blankets 71.1, 71.2 mounted thereon for transferring an inked image from the print forms 70.1, 70.2 to a web of material 22 as shown in FIG. 3. The printing blanket 71 may be constructed as a flat blanket mounted by its respective ends to the blanket cylinder, as a gapless tubular printing blanket mounted axially over the blanket cylinder, or in any other known manner.

A blanket cylinder cooling unit 8 is assigned to the upper and lower blanket cylinders 4, 6. The blanket cylinder cooling unit 8 includes a blanket cylinder inlet 8.1 and a blanket cylinder outlet 8.2 for each blanket cylinder. A lower blanket cylinder sensor 20.2 is arranged near the lower blanket cylinder 6, and an upper blanket cylinder sensor 20.1 is arranged near the upper blanket cylinder 4. The control unit 18 has respective inputs connected to the blanket cylinder sensors 20.1, 20.2 and an output connected to the cooling unit 8. The control unit 18 periodically monitors the temperature of the blanket cylinders 4, 6 via the sensors 20.1, 20.2, and then controls the blanket cylinder cooling unit 8 as a function of the monitored temperature values as described above with regard to the print cylinders. The sensors 20 and cooling unit 8 can be constructed and controlled in the same manner as the sensors 19 and cooling unit 7.

An inker cooling unit 15 is assigned to the upper vibrator rollers 9, 10, 11, the lower vibrator rollers 12, 13 and 14, and the upper and lower fountain rollers 50.1, 50.2 respectively. The cooling unit 15 includes an upper section 15.1 assigned to the upper inker 55.1 and a lower section 15.2 assigned to the lower inker 55.2. An inker inlet pipe 15.3 and outlet pipe 15.4 is connected to each roller 9–14, 50.1, 50.2. A respective inker sensor 21.1, 21.2 is assigned to each inking unit 55.1, 55.2. In the configuration of FIG. 1, sensor 21.1 senses the temperature at an outer ink carrying surface of roller 11, and sensor 21.2 senses the temperature at an outer ink carrying surface of roller 14. The control unit 18 has respective inputs connected to the inker sensors 21.1, 21.2 and an output connected to the inker cooling unit 15. The control unit 18 periodically monitors the temperature of the vibrator rollers 11, 14 via the sensors 20.1, 20.2, and then controls the inker cooling unit 15 as a function of the monitored temperature values as described above with regard to the print cylinders. The sensors 21 and cooling unit 15 can be constructed and controlled in the same manner as the sensors 19 and cooling unit 7.

Figure 2A:
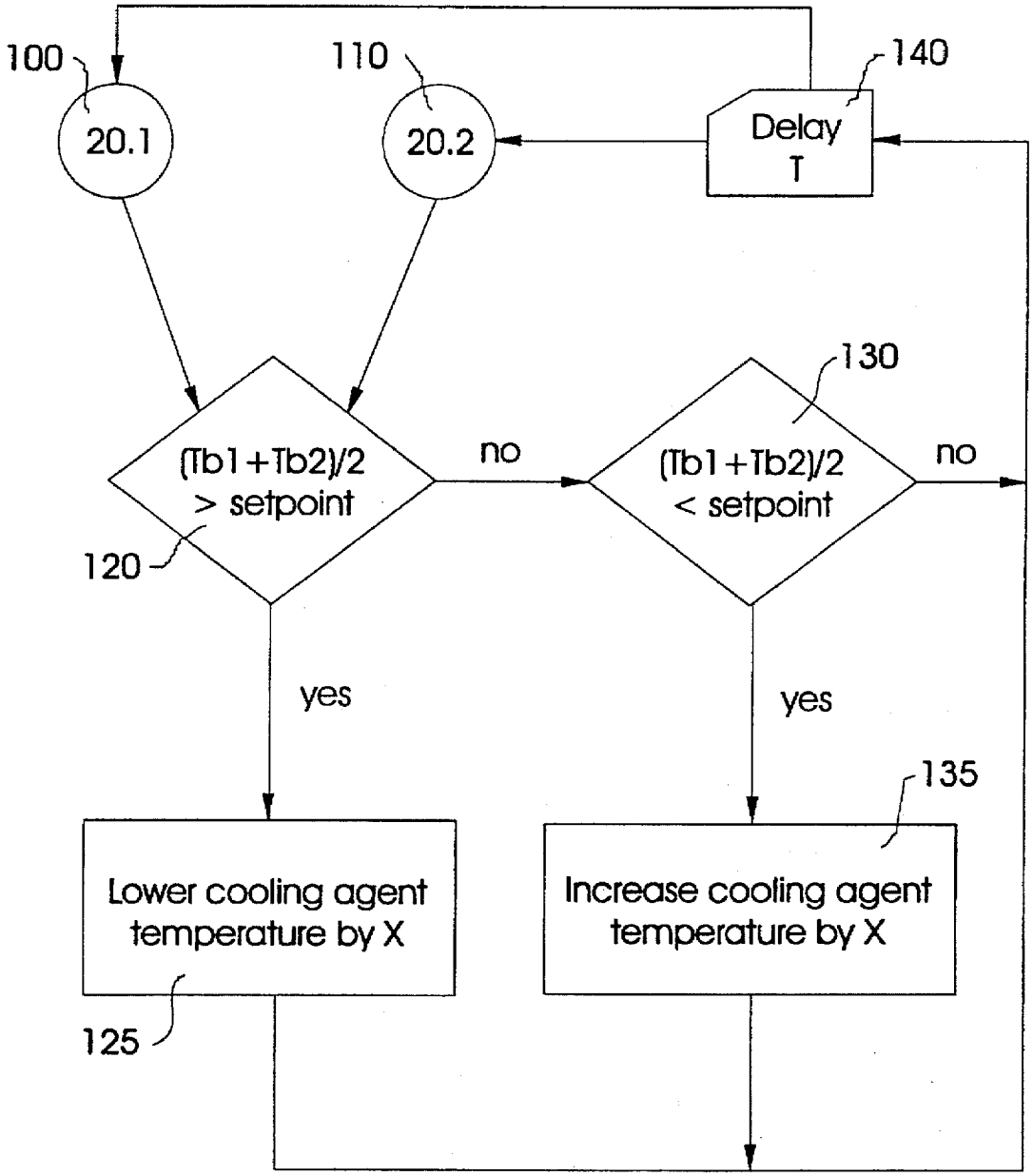
FIG. 2(*a–c*) show illustrative flow charts for the control unit of FIG. 1.
Figure 2B:
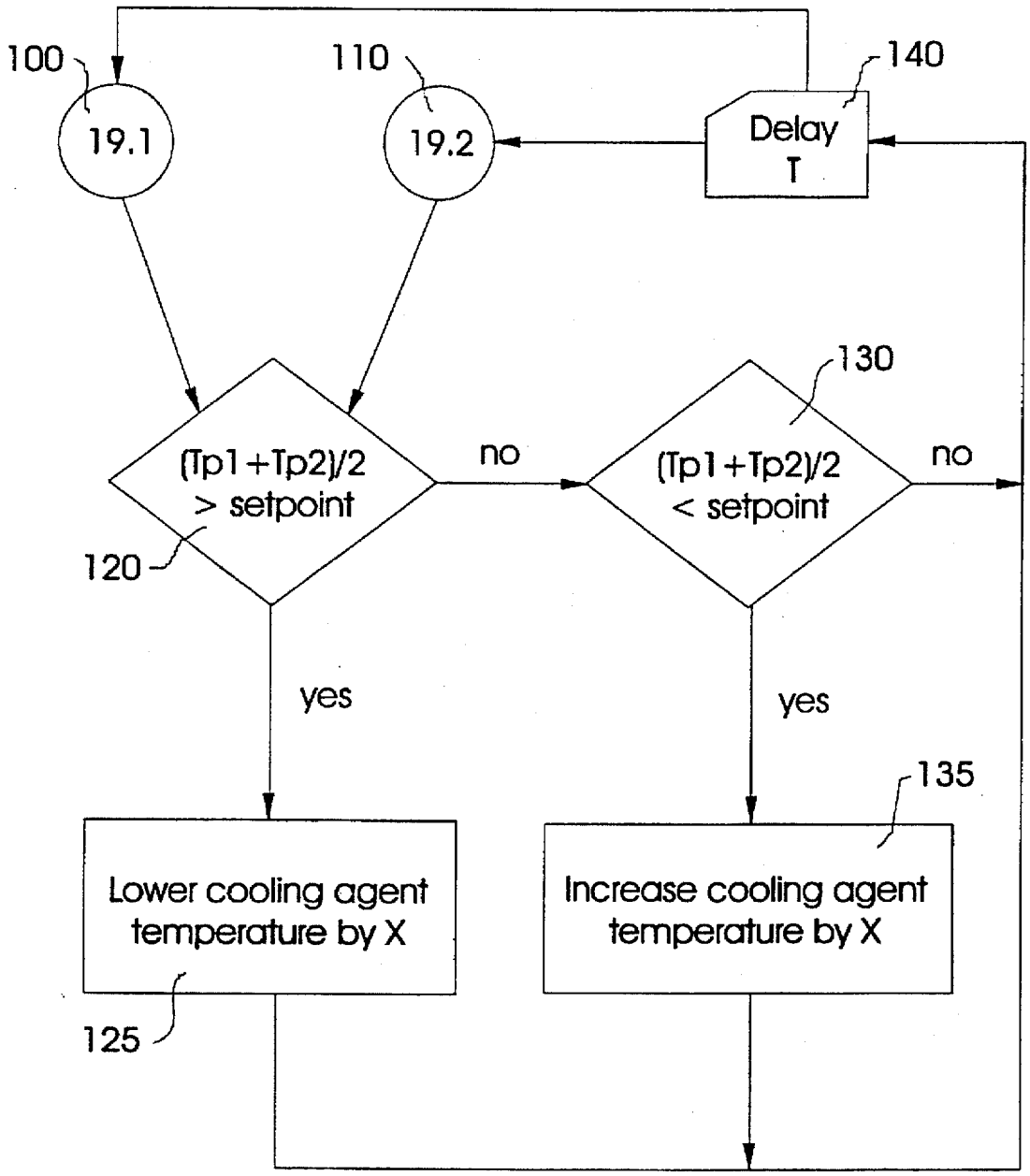
Figure 2C:
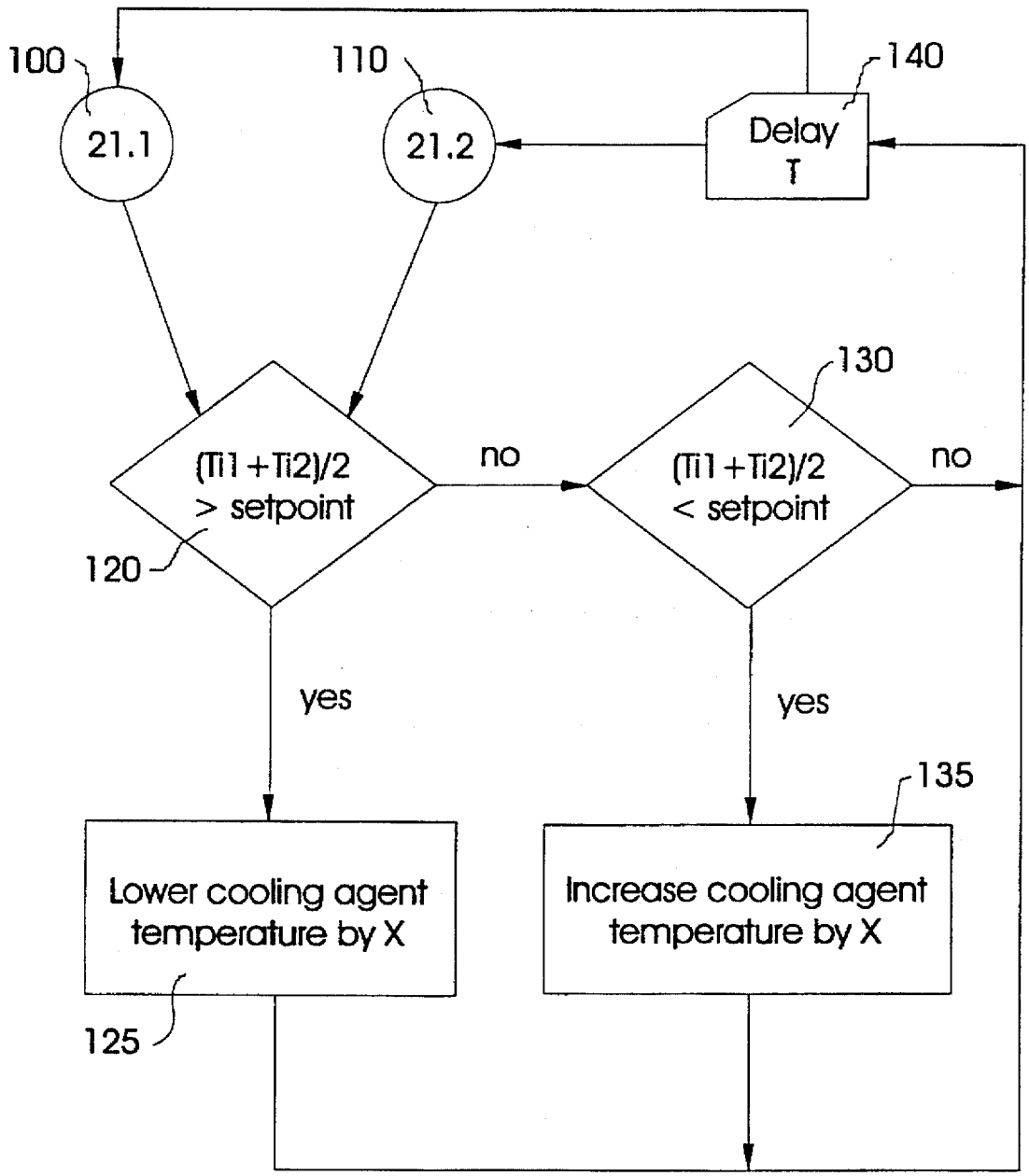

FIGS. 2(*a–c*) show an illustrative flow chart for the control unit 18. Referring to FIG. 2*a*, the control unit monitors the surface temperature of the upper blanket ($Tb_1$) and of the lower blanket ($Tb_2$) via the sensors 20.1, 20.2. If an average of these sensor readings is above a set point, then the control unit 18 lowers the temperature of the cooling agent in the blanket cooling unit 8 by an amount X, waits a time period T, and then monitors the outputs of the sensors 20.1, 20.2 again. These steps are repeated until the average of the sensor readings is equal to the set point. Similarly, if the average of these sensor readings is below the set point, then the control unit 18 raises the temperature of the cooling agent in the blanket cooling unit 8 by an amount X, waits a time period T, monitors the outputs of the sensors 20.1, 20.2 again, and repeats these steps until the average of the sensor readings is equal to the set point As illustrated in FIGS. 2*b* and 2*c*, the control unit monitors and controls the temperature of the print cylinders 3, 5 and inker rollers 9–14, 50.1, 50.2 in the same manner. Preferably, the setpoint is set slightly above the dew point of the atmosphere surrounding the print cylinders, blanket cylinders, and inking unit. In this manner, the relative humidity of the atmosphere surrounding the ink carrying surfaces of the inking unit, blanket cylinders, and print cylinders will be high enough to prevent any significant evaporation of water from the ink, but low enough to prevent condensation of water from the atmosphere onto the ink carrying surfaces. The set point can be obtained based upon the monitored values of the sensors 60.1 through 60.4 as described above.

It should be noted that since the temperature of the cylinders and rollers in the printing unit 1 tend to rise naturally due to the heat generated from the operation of the press, it is possible to eliminate steps 130 and 135 in the flow charts of FIGS. 2*a* through 2*c*, and to rely instead on the natural tendency of the temperature of the cylinders and rollers to rise over time. In such an embodiment, the cooling units 7, 8, and 15 need not include means for heating the cooling agent. Moreover, the above referenced flow charts are merely illustrative, and could be replaced with any suitable algorithm known in the art for matching a measured value to a desired value.

In the embodiment shown in FIGS. 1 and 2, separate sensors 19.1, 19.2 are provided for the upper and lower print cylinders 3, 5, and the temperature of the cooling agent applied to both cylinders is a function of the average of the two sensor readings. However, it is also possible to control the temperature of the cooling agent as a function of the temperature measured at only one of the cylinders (3 or 5) by one sensor (19.1 or 19.2). Similarly, a single temperature sensor (60.3 or 60.4) and humidity sensor (60.1 or 60.2) could be used. In such an embodiment, the temperature of the cooling agent circulated within both print cylinders will be a function of the temperature measured at the ink carrying surface of only one of the cylinders (3 or 5). The sensor pairs 20.1, 20.2 and 21.1, 21.2 could likewise be replaced with single sensors measuring the temperature at one of the blanket-cylinders (4 or 6) and at one of the inking units (55.1 or 55.2).

Moreover, it is also possible to provide separate cooling units for some or all of the cylinders 3, 4, 5, 6 and rollers 9, 10, 11, 12, 13, 14 50.1, 50.2 and to control the temperature of the cooling agent applied to these cylinders and rollers individually via the control unit as a function of separate sensors.

In order to provide acceptable conditions for priming with water based inks, the temperature of the ink and of the surfaces the ink is applied to should be maintained at certain predetermined levels. For example, in a water based ink containing 2% ethanol amine or ammonia, if the temperature of the print cylinders is maintained between 93–95 degrees, and 75–95% humidity, high print quality can be maintained. Naturally, these levels are merely illustrative, and may vary in accordance with a number of factors including the particular construction of the printing unit, the particular composition of the water based ink, and the paper being used. In accordance with the present invention, the temperature of the cylinders 3–6 and rollers 9–14 are monitored by the control unit, and is maintained within the desired temperature range (or at a desired set point) by selectively controlling the temperature of the cooling agent flowing through these cylinders and rollers.

For example, when a printing press is first started, the printing unit components 3–6, 9–14, 50.1, 50.2 will be relatively cold. Therefore, the control unit 18, by monitoring the temperature sensors 19–21, will determine that the temperature on the ink carrying surfaces of the blanket cylinders 4, 6, print cylinders 3, 5, and vibrator rollers 11, 14 is below the desired temperature level for the water based ink and paper being used. The control unit 18 will then advise the press operator to pre-heat the printing unit 1 prior to printing. Such a preheating could be accomplished by running the press while off impression until the temperature of the blanket cylinders 4, 6, print cylinders 3, 5, and vibrator rollers 11, 14 has reached the desired level. Alternatively, the control unit 18 could raise the temperature of the cooling agent in the blanket cylinder cooling unit 8, the print cylinder cooling unit 7, and the inker cooling unit 15 until the temperature of the blanket cylinders 4, 6, print cylinders 3, 5, and vibrator rollers 11, 14 has reached the desired level.

In contrast, after the printing press has been printing for a period of time, the temperature on the ink carrying surfaces of one or more of the blankets, print forms or rollers (70, 71, 9–14, 50.1, 50.2) within the printing unit 1 may rise above the desired temperature level. The control unit 18, by monitoring the temperature sensors 19–21, will detect that the temperature on the ink carrying surfaces of the blankets, print forms, and/or vibrator rollers (71.1, 71.2, 70.1, 70.2, 11, and/or 14) is above the desired temperature level for the water based ink and paper being used, and will then lower the temperature of the cooling agent in the respective cooling units (7, 8, and/or 15) as necessary until the temperature of the blankets, print forms, and/or vibrator rollers has reached the desired level.

FIG. 3 shows a further embodiment of the printing unit of FIG. 1. The pipes 7.1, 7.2, 8.1, 8.2, 15.3, 15.4 and sensors 19–21 have been omitted for ease of illustration. In accordance with this embodiment, blowing sections 23.1, 23.2 are mounted within the printing unit 1, and connected to a blowing unit 23 via an air inlet pipe 24.1 and an air exhaust pipe 24.2. The blowing unit 23 includes an air cooling mechanism and an air heating mechanism, and is coupled to and controlled by the control unit 18 to maintain the temperature of the water based ink carrying surfaces of the blanket cylinders 4, 6 at the set point. The blowing devices 23.1 and 23.2 each include outputs 80 to blow air onto the surfaces of the blanket cylinder 4, 6 carrying the water based ink films. The blowing devices 23.1 and 23.2 also include suction inputs 81 for sucking the atmosphere surrounding the water based ink carrying surfaces out through the air exhaust pipe 24.2. In this manner, the water based ink carrying surfaces of the blanket are cooled or heated from the outside via the blowing unit 23, and from the inside via the cooling units 8.

Figure 3A:
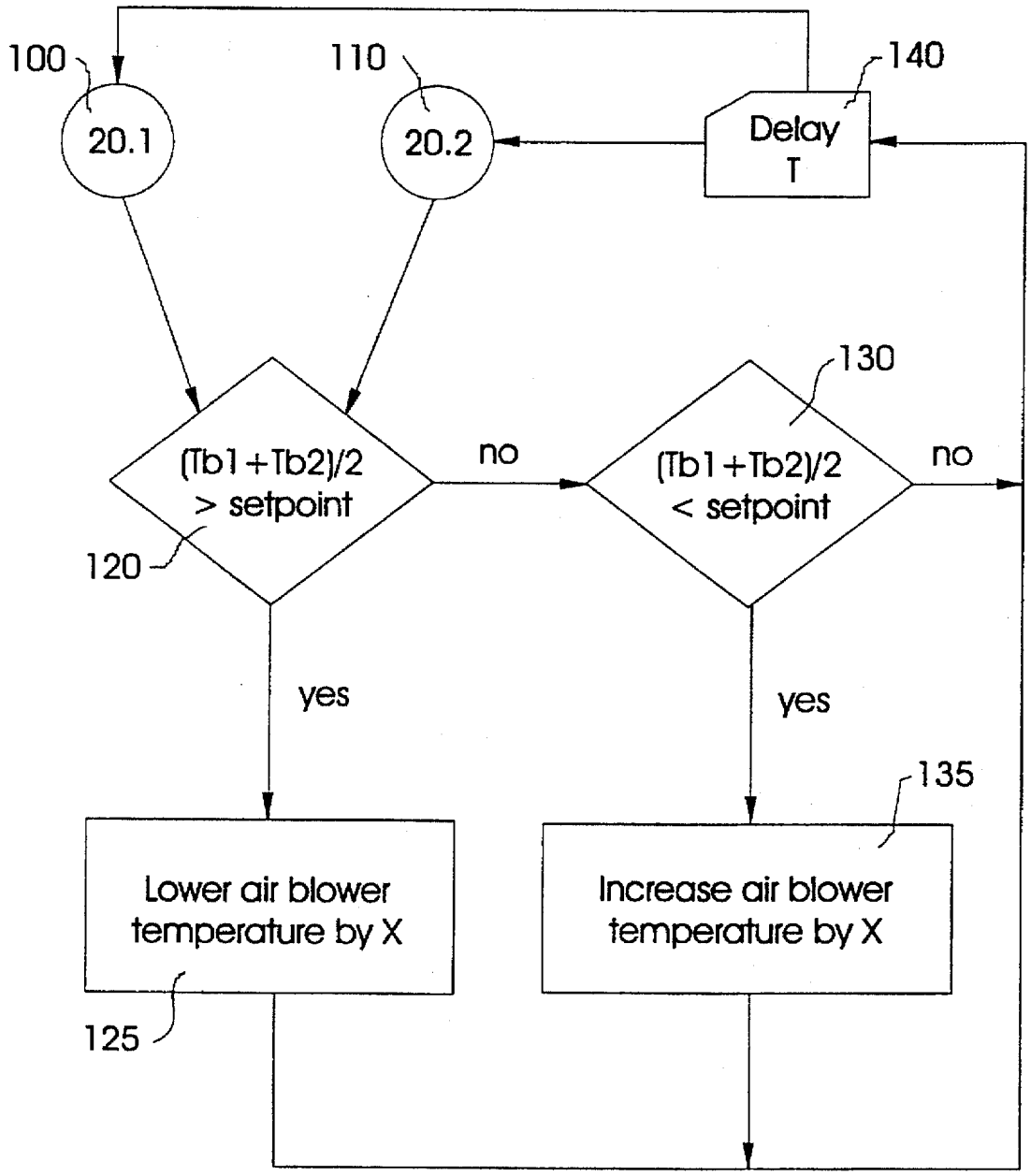

Referring to FIG. 3A, the control unit 18 monitors the surface temperature of the upper blanket cylinder ($Tb_1$ and of the lower blanket cylinder ($Tb_2$) via the sensors 20.1, 20.2. If an average of these sensor readings is above the set point, then the control unit 18 lowers the temperature of the air output from the air inlet 24.1 by an amount X, waits a time period T, and then monitors the outputs of the sensors 20.1, 20.2 again. These steps are repeated until the average of the sensor readings is equal to the set point. Similarly, if the average of these sensor readings is below the set point, then the control unit 18 raises the temperature of the air output from the air inlet 24.1 by an amount X, waits a time period T, monitors the outputs of the sensors 20.1, 20.2 again, and repeats these steps until the average of the sensor readings is equal to the set point. The heating and/or cooling of the air by the blowing device 23 can be accomplished inside or outside the blowing devices 23.1, 23.2. Moreover, in accordance with a further embodiment of the present invention, the blowing devices 23.1, 23.2 could be arranged within the printing unit 1 to blow air on both the print cylinders 3, 5 and the blanket cylinders 4, 6.

As discussed above with regard to FIGS. 2(*a–c*), since the temperature of the cylinders and rollers in the printing unit 1 tends to rise naturally due to the heat generated from the operation of the press, it is possible to eliminate steps 130 and 135 in the flow charts of FIG. 3*a*, and to rely instead on the natural tendency of the temperature of the cylinders and rollers to rise over time. In such an embodiment, the air heating mechanism can be omitted from the blowing device 23. In addition, the above referenced flow chart is merely illustrative, and could be replaced with any suitable algorithm known in the art for matching a measured value to a desired value.

In accordance with another embodiment of the present invention, the blowing unit 23 includes a humidifier 255 which is controlled by the control unit 18 and supplied by water supply lines 250.1, 250.2. The humidifier 255 may be arranged within the blowing unit 23, within the blowing devices 23.1, 23.2, in between the blowing unit 23 and blowing devices 23.1, 23.2, or in any other suitable location. If the control unit 18 determines that the monitored relative humidity is below a humidity set point, it will activate the humidifier until the monitored humidity is equal to the humidity set point. By maintaining the humidity of the atmosphere surrounding the ink carrying surfaces at the humidity setpoint (e.g. between 75% and 95% relative humidity), evaporation of water from the water-based ink can be minimized while still preventing condensation of water into the ink. Moreover, by controlling the humidity within the atmosphere surrounding the print and/or blanket cylinders, the temperature set point can be set at a static value (e.g., 93–95 degrees Fahrenheit).

Figure 4:
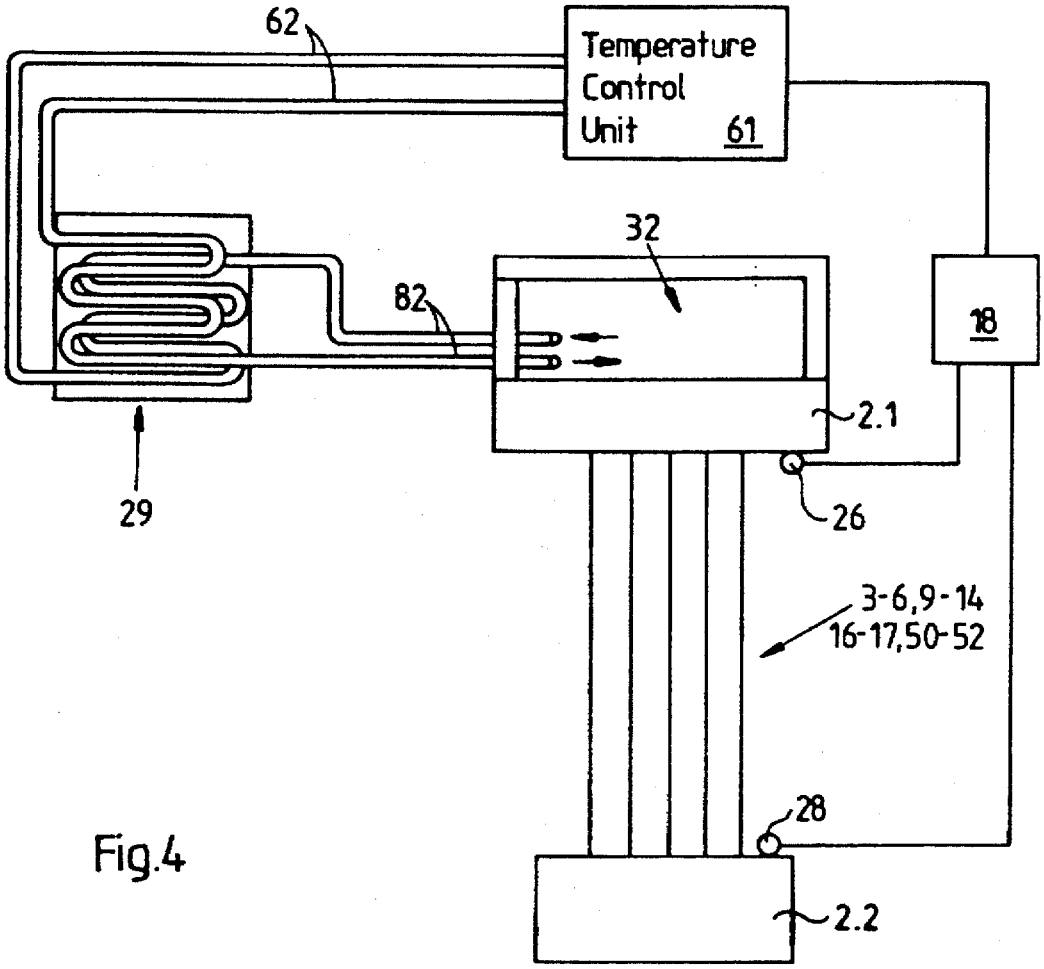
FIG. 4, 4(*a*) show devices for controlling a temperature of the side walls of a printing unit.
Figure 4A:
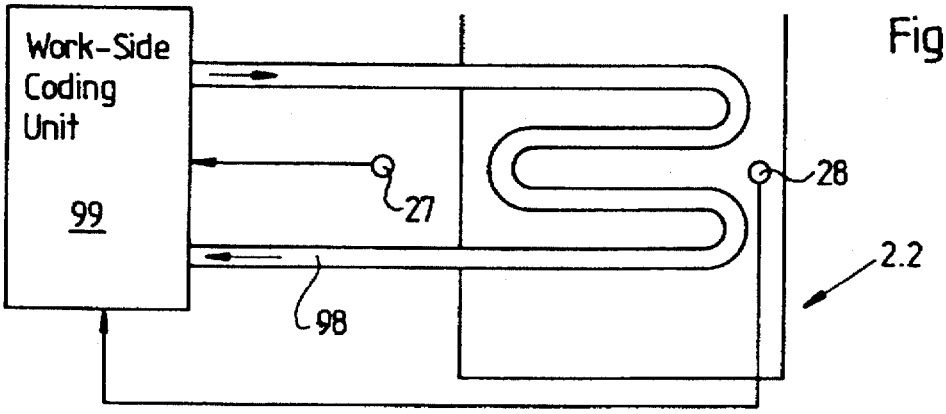

FIG. 4 shows a temperature controlling device in accordance with the present invention for maintaining an even temperature profile across the printing unit 1. The sidewalls 2 include a gear-side wall 2.1 and a work-side wall 2.2. During press operation, the gear-side wall 2.1, which houses the gears which drive the cylinders and/or rollers in the printing unit 1, tends to become significantly hotter than the work-side wall 2.2. Consequently, it is advantageous to cool the gear-side wall 2.1 to provide an even temperature profile over the width of said printing unit 1.

In accordance with the present invention, a gear-side temperature sensor 26 is mounted on the gear-side wall 2.1 and a work-side temperature sensor 28 is mounted on the work-side wall 2.2. Each of the temperature sensors 26, 28 is connected to the control unit 18. A friction reducing fluid such as mineral oil or synthetic oil is conventionally provided within a gear box 32 of the gear-side wall 2.1 to lubricate the moving parts within the gear-side wall 2.1. A fluid distribution 82 is provided for circulating the friction reducing fluid to and from a heat exchanger 29. The heat exchanger 29 may be of conventional construction, and operates to cool the fluid in the fluid distribution 82 by, for example, inter-twining the fluid distribution 82 with a fluid pipe 62 containing a cooling fluid such as water. The control unit 18 monitors the temperature of the work-side and gear-side walls 2.2, 2.1 via the sensors and controls a fluid cooling unit 61 as a function of the monitored temperatures. The control unit 18, via the fluid cooling unit 61, adjusts the temperature of the cooling fluid within the fluid pipe 62 in order to maintain a temperature differential between the values measured at sensors 26 and 28 within a certain setpoint range (e.g. $|T_{26}-T_{28}|<=7$ degrees Fahrenheit).

In the above embodiment, it is anticipated that the design of the work-side frame components is such that the temperature of the work-side frame at 27 does remains within approximately 10 degrees Farenheit of the ambient temperature of the surrounding atmosphere. If, however, the work-side frame exceeds the ambient temperature by more than 10 degrees Farenheit, it may be necessary to provide a work-side cooling mechanism for the work side frame 2.2. Referring to FIG. 4(*a*), the cooling mechanism, could, for example, include a cooling unit 99 which circulates a cooling agent through pipes 98 which are mounted to the work-side frame 2.2. The cooling unit 99 could monitor the ambient temperature of the air surrounding the work-side frame 2.2 via a temperature sensor 27, monitor the temperature of the work-side frame 2.2 via the sensor 28, and lower the temperature of the cooling agent if the difference between the monitored values exceed 10 degrees Farenheit.

Figure 5:
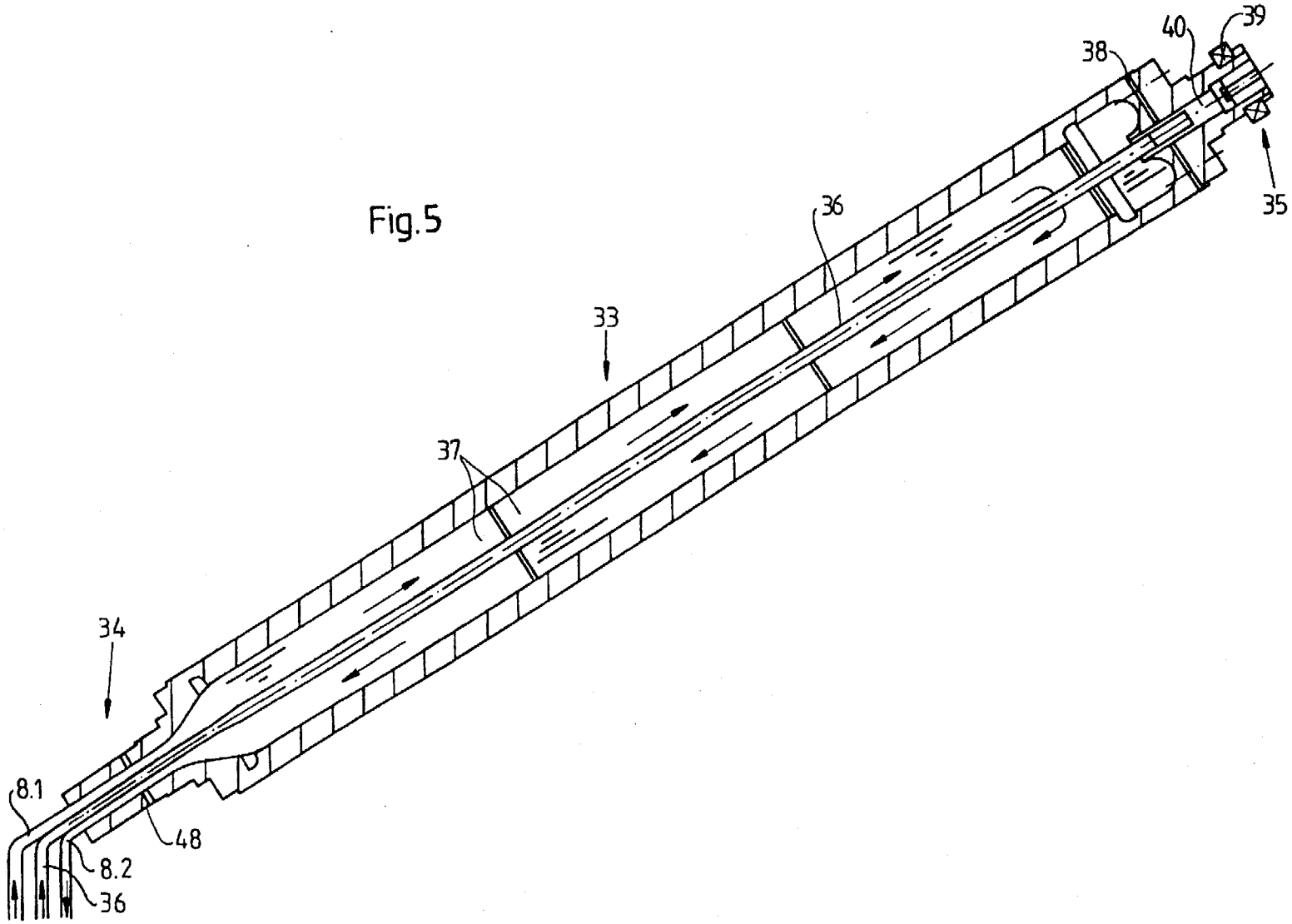
FIG. 5 shows the blanket cylinder of FIG. 1 in more detail.

FIG. 5 shows a longitudinal section of one of the blanket cylinders 4, 6. The blanket cylinder 4, 6 includes the blanket cylinder inlet 8.1 and a blanket cylinder outlet 8.2 for circulating the cooling agent through the blanket cylinder. In addition, the blanket cylinder includes a compressed air inlet 36 which transmits compressed air across the length of the cylinder and out a plurality of apertures 38 along the surface of the blanket cylinder in order to axially install and remove a printing blanket. In accordance with a preferred embodiment of the present invention, the air inlet 36 is isolated from the cooling agent circulating within the cylinder in the manner described in copending application Ser. No. 08/265,178 filed Jun. 24, 1994 entitled Distortion Reduced Lithographic Printing Press, the specification of which is hereby incorporated by reference. The cooling agent can be circulated through the print cylinder 3, 5, and rollers 9–14 in a similar manner.

What is claimed is:

1. A printing unit for a rotary printing press comprising:

a print cylinder for supporting a print form suitable for printing with water based inks, the print form having an outer ink carrying surface;

an inking unit for applying water based ink to the print form, the inking unit having an outer ink carrying surface;

a blanket cylinder for supporting a printing blanket, the printing blanket having an outer ink carrying surface; and a cooling unit for maintaining a temperature of the ink carrying surface of one or more of the print form, the inking unit, and the printing blanket at a predetermined level which is above a dew point of an atmosphere surrounding the outer ink carrying surfaces, wherein the cooling unit comprises a print cylinder cooling unit coupled to the print cylinder, the print cylinder cooling unit circulating a first cooling agent through the print cylinder to maintain the outer ink carrying surface of the print form at the predetermined level.

2. The printing unit according to claim 1, wherein the cooling unit further comprises a blanket cylinder cooling unit coupled to the blanket cylinder, the blanket cylinder cooling unit circulating a second cooling agent through the blanket cylinder to maintain the outer ink carrying surface of the printing blanket at the predetermined level.

3. The printing unit according to claim 1, wherein the inking unit further comprises a vibrator roller having an outer ink carrying surface, and wherein the cooling unit comprises a vibrator roller cooling unit coupled to the vibrator roller, the vibrator roller cooling unit circulating a second cooling agent through the vibrator roller to maintain the outer ink carrying surface of the vibrator roller at the predetermined level.

4. The printing unit according to claim 3, wherein the inking unit comprises a plurality of vibrator rollers.

5. The printing unit according to claim 3, wherein the inking unit comprises a fountain roller having an outer ink carrying surface, and wherein the vibrator roller cooling unit is coupled to the fountain roller, the vibrator roller cooling unit circulating a third cooling agent through the fountain roller to maintain the outer ink carrying surface of the fountain roller at the predetermined level.

6. The printing unit according to claim 1, further comprising:

a temperature sensor mounted within the printing unit;

a control unit having an input coupled to the temperature sensor and an output connected to the cooling unit, the control unit controlling the cooling unit as a function of a temperature value received from the temperature sensor.

7. The printing unit according to claim 1, further comprising:

a print form temperature sensor mounted within the printing unit;

a control unit having an input coupled to the print form temperature sensor and an output connected to the print cylinder cooling unit, the control unit controlling a temperature of the first cooling agent as a function of a print form temperature value received from the print form temperature sensor.

8. The printing unit according to claim 2, further comprising:

a blanket temperature sensor mounted within the printing unit;

a control unit having an input coupled to the blanket temperature sensor and an output connected to the blanket cylinder cooling unit, the control unit controlling a temperature of the second cooling agent as a function of a blanket temperature value received from the blanket temperature sensor.

9. The printing unit according to claim 3, further comprising:

a vibrator temperature sensor mounted within the printing unit;

a control unit having an input coupled to the vibrator temperature sensor and an output connected to the vibrator roller cooling unit, the control unit controlling a temperature of the second cooling agent as a function of a vibrator temperature value received from the vibrator temperature sensor.

10. The printing unit according to claim 1, further comprising:

an air blower mounted within the printing unit, the air blower having an air intake for blowing air into an atmosphere around the blanket cylinder and an air exhaust for sucking air out of the atmosphere around the blanket cylinder.

11. The printing unit according to claim 10, further comprising:

a blanket temperature sensor for monitoring a blanket temperature level of the printing blanket;

a control unit having an input connected to the blanket temperature sensor and having outputs connected to the air blower and the cooling unit, the control unit controlling the air blower and cooling unit as a function of the blanket temperature level received from the blanket temperature sensor.

12. The printing unit according to claim 11, wherein the air blower further comprises an air cooling mechanism.

13. The printing unit according to claim 12, wherein the air blower further comprises a humidifier.

14. The printing unit according to claim 11, wherein the air blower further comprises a fan and an air heating mechanism.

15. The printing unit according to claim 1, further comprising:

a humidity sensor mounted within the printing unit;

a control unit having an input coupled to the humidity sensor and an output connected to the cooling unit, the control unit controlling the cooling unit as a function of a humidity value received from the humidity sensor.

16. A printing unit for a rotary printing press comprising:

a print cylinder for supporting a print form suitable for printing with water based inks, the print form having an outer ink carry surface;

an inking unit for applying water based ink to the print form, the inking unit having an outer ink carrying surface;

a blanket cylinder for supporting a printing blanket, the printing blanket having an outer ink carrying surface; and a cooling unit for maintaining a temperature of the ink carrying surface of one or more of the print form, the inking unit, and the printing blanket at a predetermined level, wherein the cooling unit includes a blanket cylinder cooling unit coupled to the blanket cylinder, the blanket cylinder cooling unit circulating a cooling agent through the blanket cylinder to maintain the outer ink carrying surface of the printing blanket at the predetermined level.

17. The printing unit according to claim 16, further comprising:

a blanket temperature sensor mounted within the printing unit;

a control unit having an input coupled to the blanket temperature sensor and an output connected to the blanket cylinder cooling unit, the control unit controlling a temperature of the cooling agent as a function of a blanket temperature value received from the blanket temperature sensor.

18. The printing unit according to claim 16, further comprising:

a temperature sensor mounted within the printing unit;

a control unit having an input coupled to the temperature sensor and an output connected to the cooling unit, the control unit controlling the cooling unit as a function of a temperature value received from the temperature sensor.

19. The printing unit according to claim 16, further comprising:

a humidity sensor mounted within the printing unit;

a control unit having an input coupled to the humidity sensor and an output connected to the cooling unit, the control unit controlling the cooling unit as a function of a humidity value received from the humidity sensor.

20. A printing unit for a rotary printing press comprising:

a print cylinder for supporting a print form suitable for printing with water based inks, the print form having an outer ink carrying surface;

an inking unit for applying water based ink to the print form, the inking unit having an outer ink carrying surface;

a blanket cylinder for supporting a printing blanket, the printing blanket having an outer ink carrying surface;

a cooling unit for maintaining a temperature of the ink carrying surface of one or more of the print form, the inking unit, and the printing blanket at a predetermined level which is above a dew point of an atmosphere surrounding the outer ink carrying surfaces, wherein the cooling unit circulates an agent through one or more of the print cylinder, the blanket cylinder, and inking unit, and wherein the cooling unit further includes an agent cooling mechanism and an agent heating mechanism.

21. A printing unit for a rotary printing press comprising:

a print cylinder for supporting a print form suitable for printing with water based inks, the print form having an outer ink carrying surface;

an inking unit for applying water based ink to the print form, the inking unit having an outer ink carrying surface;

a blanket cylinder for supporting a printing blanket, the printing blanket having an outer ink carrying surface;

a cooling unit for maintaining a temperature of the ink carrying surface of one or more of the print form, the inking unit, and the printing blanket at a predetermined level which is above a dew point of an atmosphere surrounding the outer ink carrying surfaces;

a gear side wall including a gear box;

a work-side wall, the blanket cylinder and print cylinder supported for rotation by the gear-side and work-side walls;

a first sensor mounted to the gear-side wall for monitoring a gear-side temperature level;

a second sensor mounted to the work-side wall for monitoring a work-side temperature level;

a heat exchanger coupled to the gear box for controlling a temperature of a fluid within the gear box; and a control unit having inputs connected to the first and second sensors and having an output connected to the heat exchanger, the control unit actuating the heat exchanger as a function of the work-side and gear-side temperature levels.

22. The printing unit according to claim 21, further comprising:

a temperature sensor for monitoring an ambient temperature level of an atmosphere surrounding the work side wall;

a work side cooling mechanism having inputs coupled to the temperature sensor and the second sensor, and an output coupled to the work-side wall, the work side cooling mechanism controlling the temperature of the work-side wall as a function of the monitored work-side temperature level and ambient temperature level.

* * * * *